US005726690A

United States Patent [19]

Bohorquez et al.

[11] Patent Number: 5,726,690

[45] Date of Patent: Mar. 10, 1998

[54] CONTROL OF INK DROP VOLUME IN THERMAL INKJET PRINTHEADS BY VARYING THE PULSE WIDTH OF THE FIRING PULSES

[75] Inventors: Jaime H. Bohorquez; Clayton Holstun, both of Escondido, Calif.; Brian P. Canfield; Susan Tousi, both of Barcelona, Spain; Kenneth J. Courian, San Diego; Frank Drogo, San Marcos, both of Calif.

[73] Assignee: Hewlett-Packard Company, Palo Alto, Calif.

[21] Appl. No.: 316,009

[22] Filed: Sep. 30, 1994

Related U.S. Application Data

[63] Continuation of Ser. No. 056,960, May 3, 1993, abandoned, which is a continuation-in-part of Ser. No. 983,009, Nov. 30, 1992, abandoned, which is a continuation-in-part of Ser. No. 694,185, May 1, 1991, Pat. No. 5,168,284.

[51] Int. Cl.[6] ..... B41J 2/205; B41J 29/393

[52] U.S. Cl. ..... 347/15; 347/19

[58] Field of Search ..... 347/9, 10, 15, 347/19, 57, 12, 14

[56] References Cited

U.S. PATENT DOCUMENTS

| | | | |
|---|---|---|---|
| 4,345,262 | 8/1982 | Shirato et al. | 347/10 |
| 4,710,784 | 12/1987 | Nakayama | 347/15 |
| 5,036,337 | 7/1991 | Rezanka | 347/14 |
| 5,428,376 | 6/1995 | Wade et al. | 347/14 |

*Primary Examiner*—Benjamin R. Fuller
*Assistant Examiner*—Craig A. Hallacher
*Attorney, Agent, or Firm*—Dennis G. Stenstrom; Manuel Quiogue

[57] ABSTRACT

A method of operating a thermal inkjet printer having a thermal inkjet printhead that includes the steps of selecting an ink drop volume, selecting a pulse width that will cause the thermal inkjet printhead to deposit an ink drop having the selected drop volume, and operating the thermal inkjet printhead with the selected pulse width and at an operating energy that is greater than a turn-on energy of the printhead for the selected pulse width.

3 Claims, 8 Drawing Sheets

CONTROL OF INK DROP VOLUME IN THERMAL INKJET PRINTHEADS BY VARYING THE PULSE WIDTH OF THE FIRING PULSES

This is a continuation of application Ser. No. 08/056,960, filed May 3, 1993 abandoned, which is a continuation-in-part of commonly assigned application Ser. No. 07/983,009, filed Nov. 30, 1992 abandoned, entitled METHOD AND APPARATUS FOR REDUCING THE RANGE OF DROP VOLUME VARIATION IN THERMAL INK JET PRINTERS by Brian P. Canfield, et al., which is a continuation-in-part of application Ser. No. 07/694,185, filed May 1, 1991 entitled METHOD AND APPARATUS FOR CONTROLLING THE TEMPERATURE OF THERMAL INK JET AND THERMAL PRINTHEADS THROUGH THE USE OF NONPRINTING PULSES by King-Wah Yeung, et al., which has issued as U.S. Pat. No. 5,168,284, the entire contents of which are herein incorporated by reference.

BACKGROUND OF THE INVENTION

Thermal inkjet printers have gained wide acceptance. These printers are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. Thermal inkjet printers produce high quality print, are compact and portable, and print quickly and quietly because only ink strikes the paper.

An inkjet printer forms a printed image by printing a pattern of individual dots at particular locations of an array defined for the printing medium. The locations are conveniently visualized as being small dots in a rectilinear array. The locations are sometimes "dot locations," "dot positions," or "pixels." Thus, the printing operation can be viewed as the filling of a pattern of dot locations with dots of ink.

Inkjet printers print dots by ejecting very small drops of ink onto the print medium, and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

Color thermal inkjet printers commonly employ a plurality of printheads, for example four, mounted in the print carriage to produce different colors. Each printhead contains ink of a different color, with the commonly used colors being cyan, magenta, yellow, and black. These base colors are produced by depositing a drop of the required color onto a dot location, while secondary or shaded colors are formed by depositing multiple drops of different base color inks onto the same dot location, with the overprinting of two or more base colors producing secondary colors according to well established optical principles.

The typical thermal inkjet printhead (i.e., the silicon substrate, structures built on the substrate, and connections to the substrate) uses liquid ink (i.e., colorants dissolved or dispersed in a solvent). It has an array of precisely formed nozzles attached to a printhead substrate that incorporates an array of firing chambers which receive liquid ink from the ink reservoir. Each chamber has a thin-film resistor, known as a thermal inkjet firing chamber resistor, located opposite the nozzle so ink can collect between it and the nozzle.

When electric printing pulses heat the thermal inkjet firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

Print quality is one of the most important considerations of competition in the color inkjet printer field. Since the image output of a color inkjet printer is formed of thousands of individual ink drops, the quality of the image is ultimately dependent upon the quality of each ink drop and the arrangement of the ink drops on the print medium. One source of print quality degradation is improper ink drop volume.

Drop volumes vary with the printhead substrate temperature because the two properties that control it vary with printhead substrate temperature: the viscosity of the ink and the amount of ink vaporized by a firing chamber resistor when driven with a printing pulse.

Changes in drop volume cause variations in the darkness of black-and-white text, variations in the contrast of gray-scale images, and variations in the chroma, hue, and lightness of color images. The chroma, hue, and lightness of a printed color depends on the volume of all the primary color drops that create the printed color. If the printhead substrate temperature increases or decreases as the page is printed, the colors at the top of the page can differ from the colors at the bottom of the page. Controlling the drop volume improves the quality of printed text, graphics, and images.

Degradation in the print quality is caused by excessive amounts of ink in larger drop volumes. When at room temperature, a thermal inkjet printhead must eject drops of sufficient size to form satisfactory printed text or graphics. However, printheads that meet this performance requirement, eject drops containing excessive amounts of ink when the printhead substrate is warm. Excessive ink degrades print quality by causing feathering of the ink drops, bleeding of ink drops having different colors, and cockle and curling of the paper. In addition, different print medias, i.e., plain paper, special paper or transparencies, require different ink drop volumes for optimum performance. Controlling the ink drop volume depending on the above conditions will help eliminate these problems and improve print quality.

The drop volume from an inkjet printhead can be adjusted by using the following factors: (1) the drop generation geometry (resistor physical size and exit orifice size), (2) the forces affecting the refill speed such as backpressure, filter resistance and entrance channel restrictions, (3) factors affecting the size and strength of the drive bubble such as ink temperature, the boiling surface heating rate and boiling surface cleanliness, and (4) effects on fluidic response such as the ink viscosity which is a function of the ink temperature. The above factors can be divided into two categories: (1) factors that the printer can dynamically change and (2) factors that are fixed design parameters. Of the above factors only printhead temperature and the boiling surface heating rate (associated with the pulse width) can be dynamically adjusted by the printer.

The operating environment of the printer can affect the desired drop volume. For example in a heated printer environment a higher drop volume may be desired to make text characters look dark because drying time is not a concern due to the heating in the printzone. On the other hand, an unheated printer may be more concerned with the drying time and want to reduce the ink drop volume being deposited on the paper. One of the methods that may be employed to reduce the ink drop volume deposited on the paper is to use a shorter pulse width and its associated higher heating rate to produce smaller drive bubbles and lower drop volumes.

Printers that use thermal inkjet printheads need to have the proper drop volume in order to have acceptable print quality under all conditions and media used. In many cases different drop volumes are required for optimum print quality from the same print cartridge. The research, development, engineering and distribution expense and the time involved in inkjet printhead design for each new printer is considerable. The ability to optimize the delivered ink drop volume for a given printhead design in order to satisfy the requirements of different printer designs is necessary in order to stay competitive in the marketplace. For thermal inkjet this is a difficult requirement.

Other methods have been used to vary the delivered ink drop volume. The first method is to vary the temperature of the printhead to change the ink viscosity and increase ejection efficiency, but this places increased stress on the printhead substrate and increases the likelihood of chemical interaction of the ink with the printhead substrate. This results in decreased chemical resistance of the printhead. The second method is to use more than one drop of ink per pixel location on the media, but this has an attendant decrease in the printer's throughput.

Thus, major advantages would be obtained if a simple and inexpensive method was available to vary the ink drop volume of an existing printhead design without the necessity of re-designing the printhead which is a complex task requiring the expenditure of significant time and money. These advantages include being able to vary the drop volume in an inkjet printer depending on density of the print (e.g., graphics versus text) and the media (e.g., paper versus transparencies). Another advantage would be the ability to use an existing printhead design in printers with different operating conditions, such as heated and unheated environments.

SUMMARY OF THE INVENTION

For the reasons previously discussed, it would be advantageous to have an apparatus and a method for controlling and varying the drop volume. The foregoing and other advantages are provided by the present invention which controls the drop volume by controlling the pulse width of the delivered firing pulse. Ink drop volume control has been demonstrated over a wide range of operating conditions with improved ejection dynamics at the shorter pulse widths, improved print quality and acceptable operating life. Drop volume control using this method has been shown to improve optical density of the printed image while controlling the drying time of high print density output.

The present invention has the advantage of controlling the drop volume and increasing the quality of the print. Another major advantage of the present invention is the simplicity of the implementation in an existing printer and existing printhead. Inkjet printers are microprocessor controlled and the additional coding required to control pulse width is minimal and thus extremely inexpensive to implement compared to re-designing the printhead hardware.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

A person skilled in the art will readily appreciate the advantages and features of the disclosed invention after reading the following detailed description in conjunction with the drawings.

Figure 1:
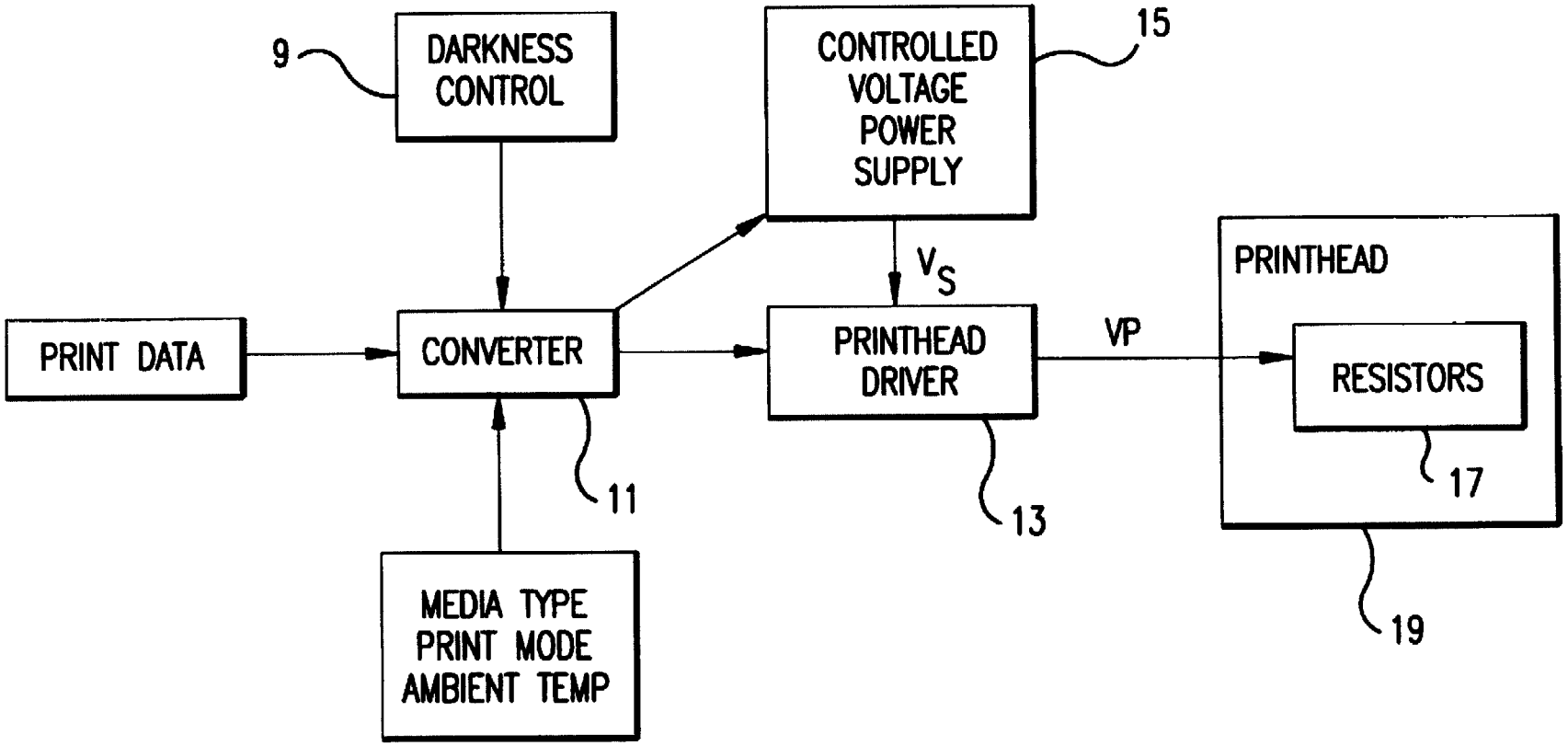
FIG. 1 is a block diagram of the present invention.

Referring to FIG. 1 there is shown a simplified block diagram of a thermal inkjet printer that employs the techniques of this invention. A controller 11 receives print data input and processes the print data to provide print control information to a printhead driver circuit 13. A controlled voltage power supply 15 provides to the printhead driver circuit 13 a controlled supply voltage $V_s$ whose magnitude is controlled by the controller 11. The printhead driver circuit 13, as controlled by the controller 11, applies driving or energizing voltage pulses of voltage $V_p$ to a thin film integrated circuit thermal inkjet printhead 19 that includes thin film ink drop firing heater resistors 17.

The controller 11, which can comprise a microprocessor architecture in accordance with known controller structures, more particularly provides pulse width and pulse frequency parameters to the printhead driver circuitry 13 which produces drive voltage pulses of the width and frequency as selected by the controller, and with a voltage $V_p$ that depends on the supply voltage $V_s$ provided by the voltage controlled power supply 15 as controlled by the controller 11. Essentially, the controller 11 controls the pulse width, frequency, and voltage of the voltage pulses applied by the driver circuit to the heater resistors.

As with known controller structures, the controller 11 would typically provide other functions such as control of the printhead carriage (not shown) and control of movement of the print media. In accordance with the invention, the controller 11 determines a turn-on pulse energy for the printhead 19 that is the minimum pulse energy at which a heater resistor produces an ink drop of the proper volume, wherein pulse energy refers to the amount of energy provided by a voltage pulse; i.e., instantaneous power multiplied by pulse width.

Figure 2:
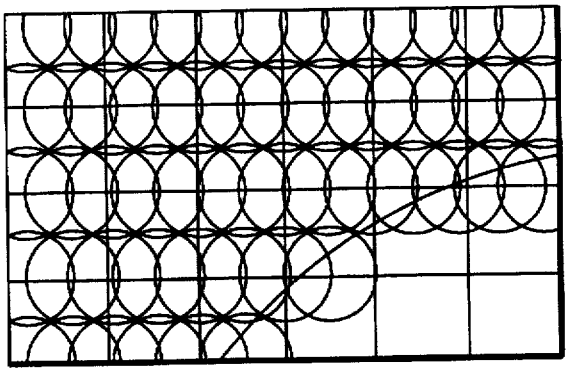
FIG. 2 shows print having a resolution of 300×600 dots per inch.
Figure 3:
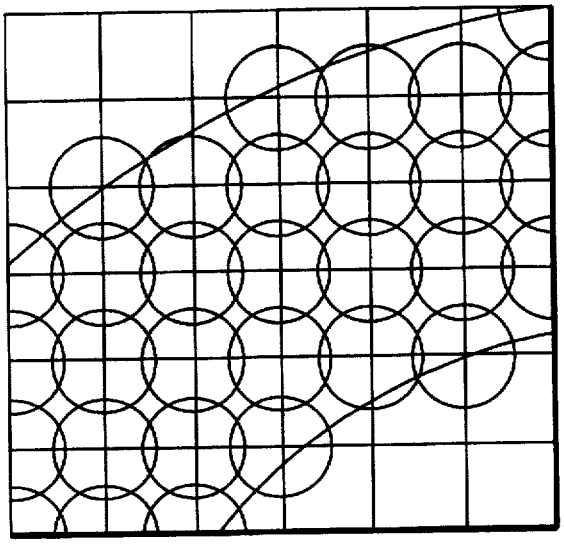
FIG. 3 shows print having a resolution of 300×300 dots per inch.
Figure 4:
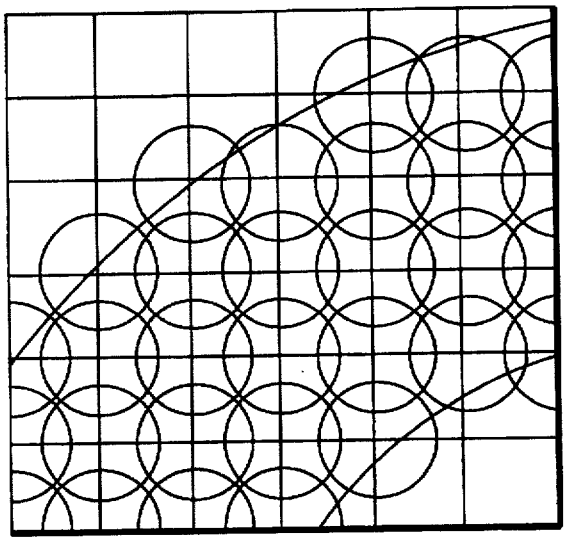
FIG. 4 shows the effect of increasing the drop size when printing at a resolution of 300×300 dots per inch.

Another aspect of the invention, is a darkness control adjustment 9, shown in FIG. 1, that allows the user to change the reference drop volume and thereby adjust the darkness of the print or the time required for the ink to dry according to personal preference or changes in the cartridge performance. The preferred embodiment of the invention changes the pulse width with changes in resolution that are caused by a change in print speed. At the standard print speed, the resolution is 300 dots per inch along the paper feed axis and 600 dots per inch across the width of the paper in the carriage scan direction which translates into twice the number of dots across the width of the paper. FIG. 2 shows the coverage of dots in 300×600 dots per inch. FIG. 3 shows the coverage of dots when the resolution is reduced to 300×300 dots per inch. At this lower resolution holes open up between the dots as seen in FIG. 3. At the lower resolution modes, the present invention increases the pulse width and decreases $V_p$ so that the printhead ejects drops with a larger volume that produces larger dots that better fill in the empty space between the dots as shown in FIG. 4.

A thermal inkjet printhead requires a certain minimum energy to fire ink drops of the proper volume (herein called the turn-on energy). Turn-on energy can be different for different printhead designs, and in fact varies among different samples of a given printhead design as a result of manufacturing tolerances. As a result, thermal inkjet printers are configured to provide a fixed ink firing energy that is greater than the expected highest turn-on energy for the printhead cartridges it can accommodate. This amount of excess energy beyond the turn-on energy is defined as the over-energy.

In accordance with the present invention, the effect of pulse width variations, at constant over-energy, on turn-on energy and drop volume has been utilized to optimize ink drop volumes for different printing conditions. Ink drop volumes were measured at a constant over energy that in one instance included 15 percent over energy so that (1) the shift in turn-on energy with pulse width is accounted for and (2) all ink drop volumes are at a constant over energy. The turn-on energy shift is due to the fact that shorter pulse widths heat the resistor and the ink more rapidly and efficiently, so as to lower the amount of energy necessary. Turn-on energy varies linearly with pulse widths in the range of 1.5 to 3.5 microseconds of approximately 0.50 microjoules/microseconds. Drop volume varied over this pulse width range with a slope of 5.0 picoliters/microsecond.

Figure 5:
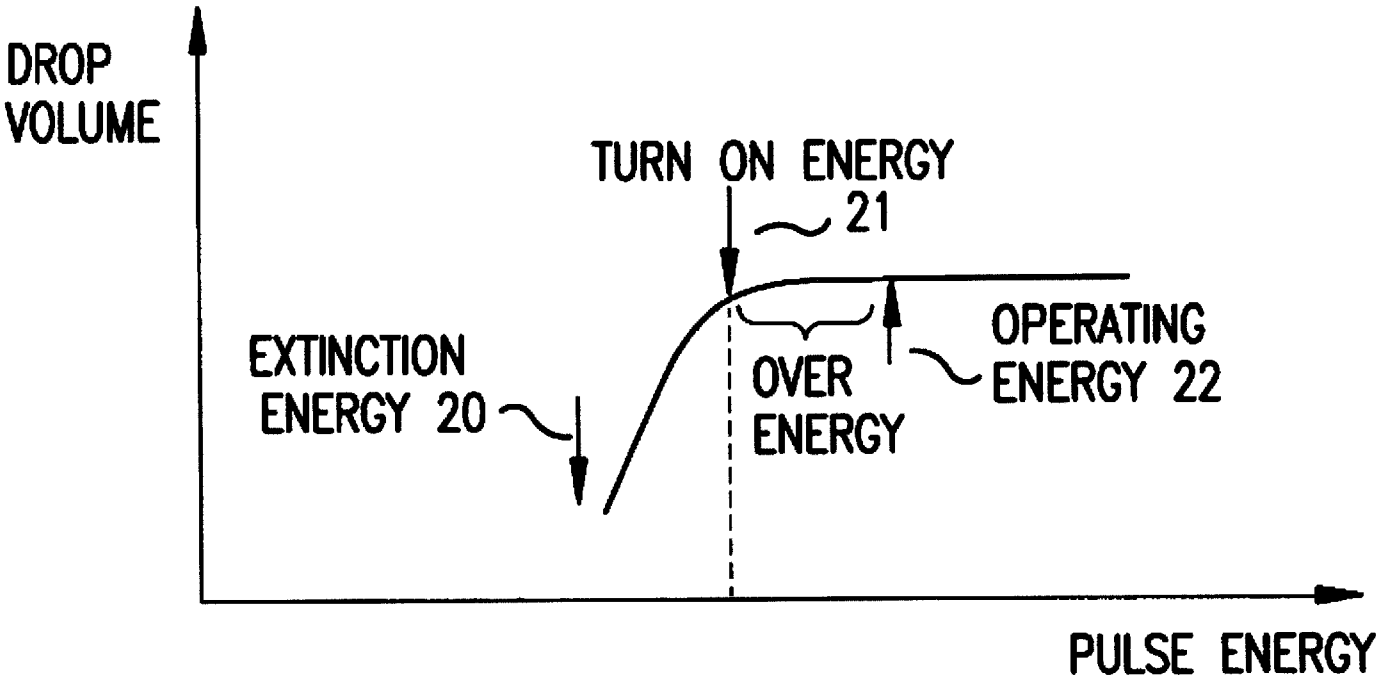
FIG. 5 is a plot of drop volume versus pulse energy for one pulse width.

The turn-on energy at any particular pulse width is determined by firing the printhead with a fixed pulse width and varying the pulse voltage $V_p$. The response of the drop volume to the range of energies tested is shown in FIG. 5 for one pulse width. Below the energy marked as the extinction energy 20, no drops are fired as the ink vaporization event does not occur. As the energy is increased from that energy increasingly larger drops are ejected until a point called the turn-on energy 21 is reached. After that point adding additional energy does not increase the drop volume further and the drop generator is said to be operating in the mature energy region. The operating energy 22 is set in this mature region.

Figure 6:
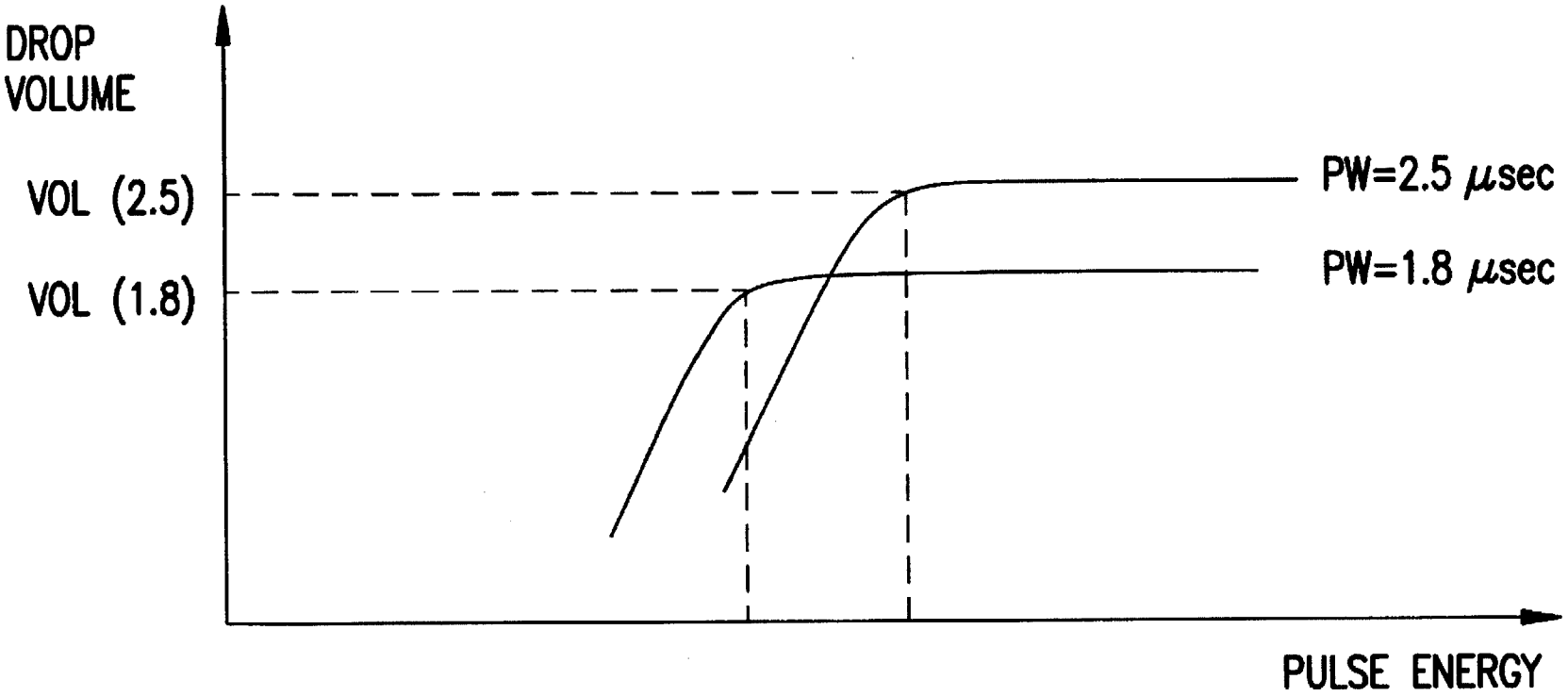
FIG. 6 is a plot of drop volume versus pulse energy for two different pulse widths.
Figure 7:
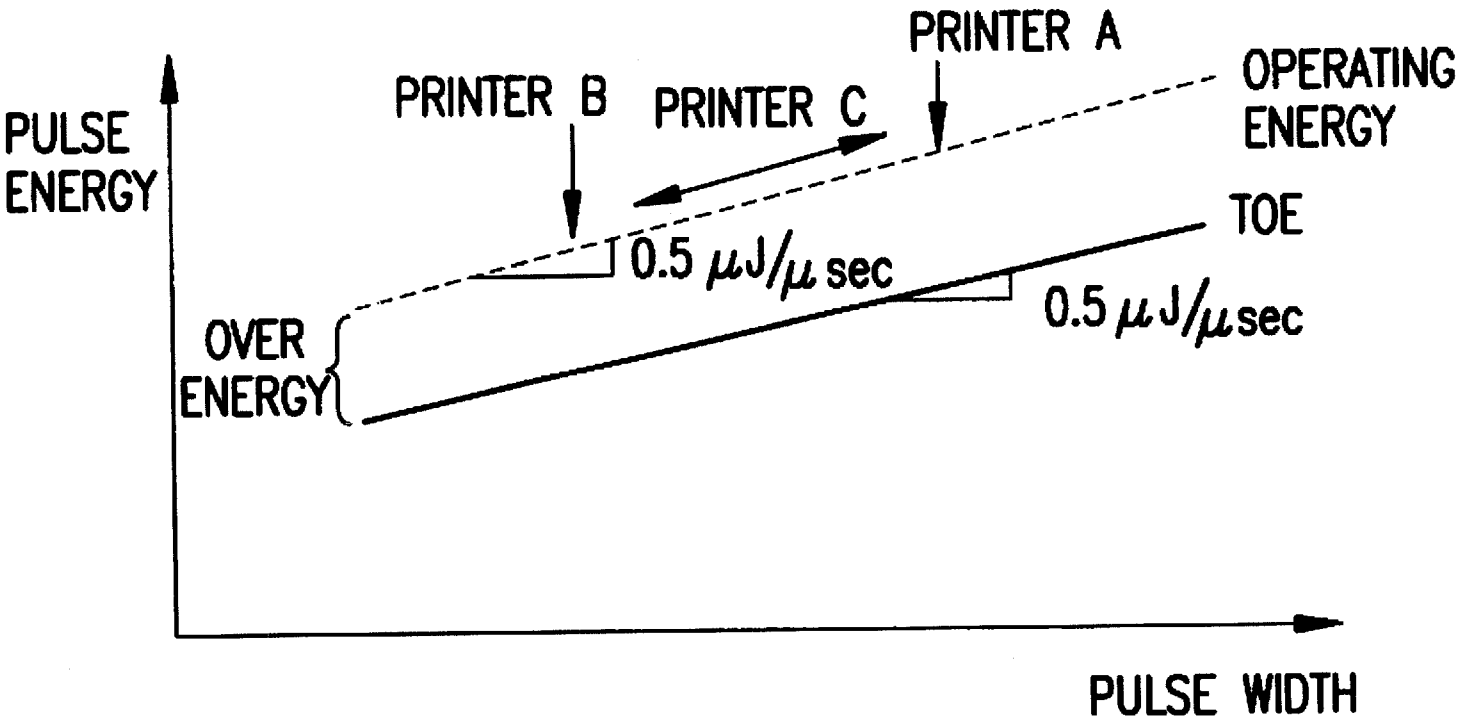
FIG. 7 is a plot of pulse energy versus pulse width.

FIG. 6 shows the response of FIG. 5 for the same ink and drop generation architecture at two different pulse widths. The turn-on energies 21 changed between the two pulse widths as does the drop volume in the mature region. This change in the mature drop volume is the effect utilized in the present invention. The change in turn-on energy 21 is accommodated by changing the operating energy 22 used between the two pulse widths at the same rate that the turn-on energy 21 changes, namely 0.5 microJoules/microsecond as shown in FIG. 7.

The effect of this change in the drop volume can be used by one printer, printer A, to produce higher drop volumes to increase optical density while the same printhead is used by printer B to produce lower drop volumes to reduce drying times. This printhead could also be used by printer C which dynamically adjusts the pulse width and the operating energy along that operating energy curve to dynamically adjust the drop volume to exploit higher volumes to produce darker output and to produce lower volumes to lighten the output at the user's request.

Figure 8:
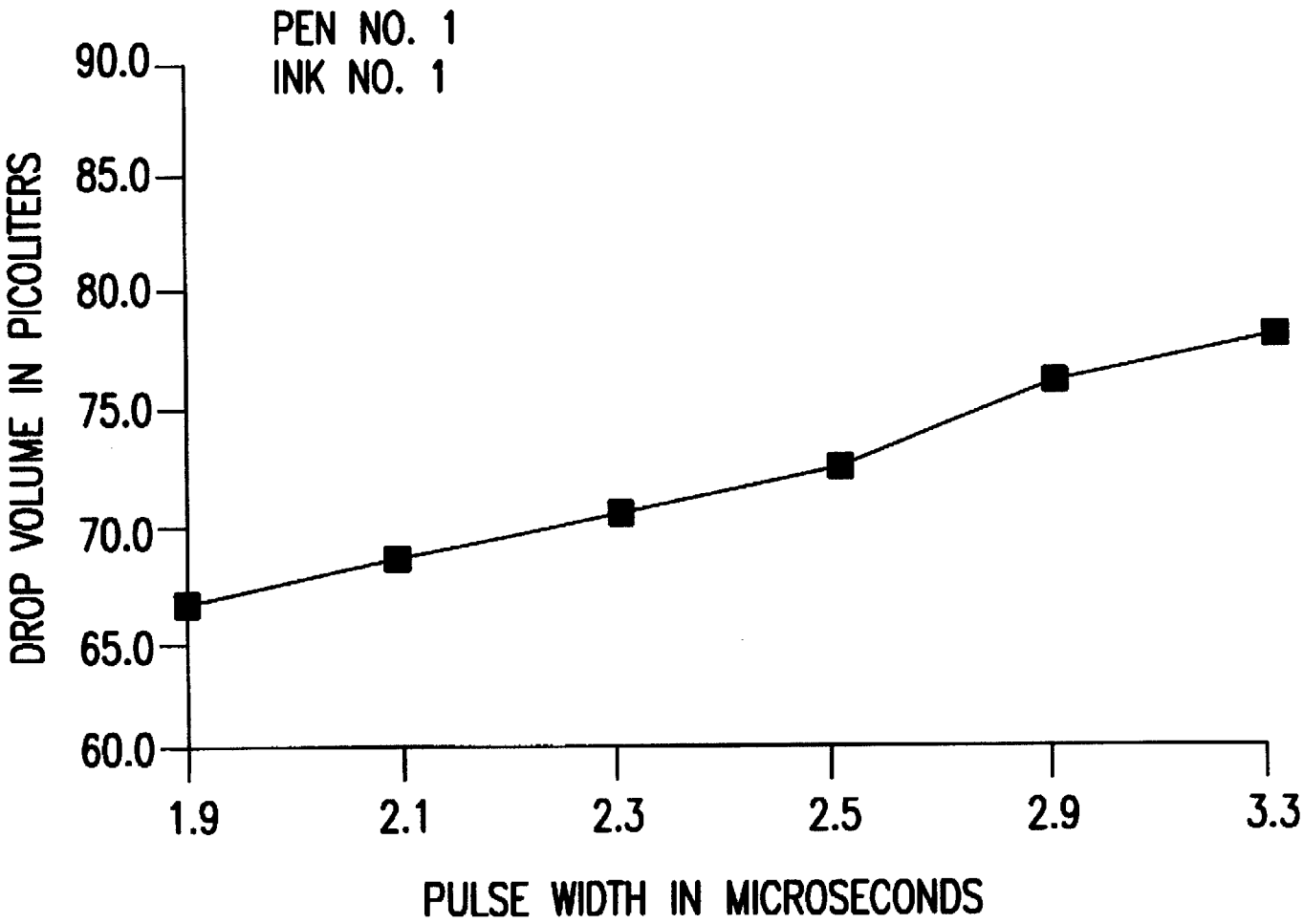
FIG. 8 shows the effect of pulse width on drop volume for a pen identified as Pen No. 1 and an ink identified as Ink No. 1.
Figure 9:
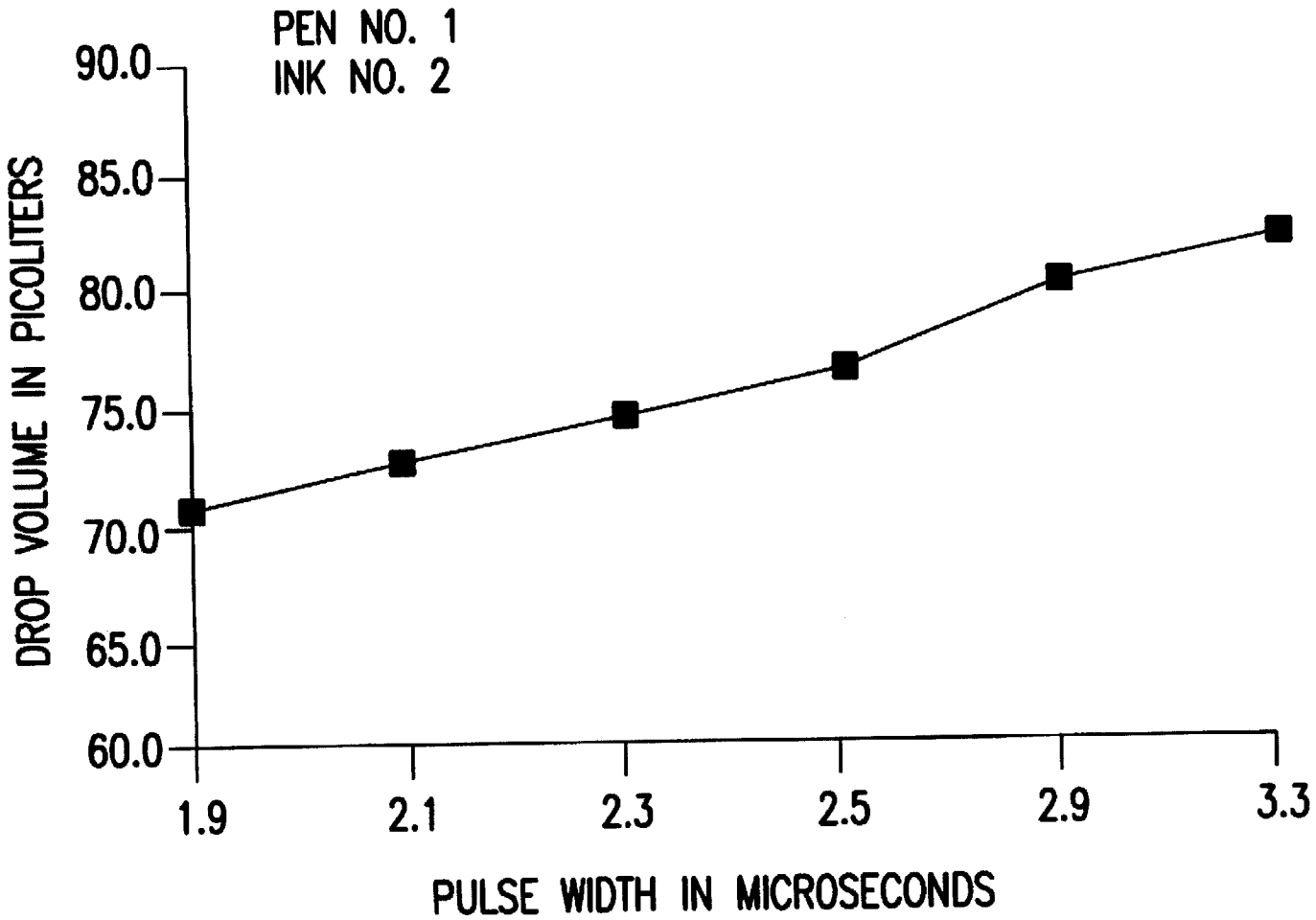
FIG. 9 shows the effect of pulse width on drop volume for the pen identified as Pen No. 1 and an ink identified as Ink No. 2.
Figure 10:
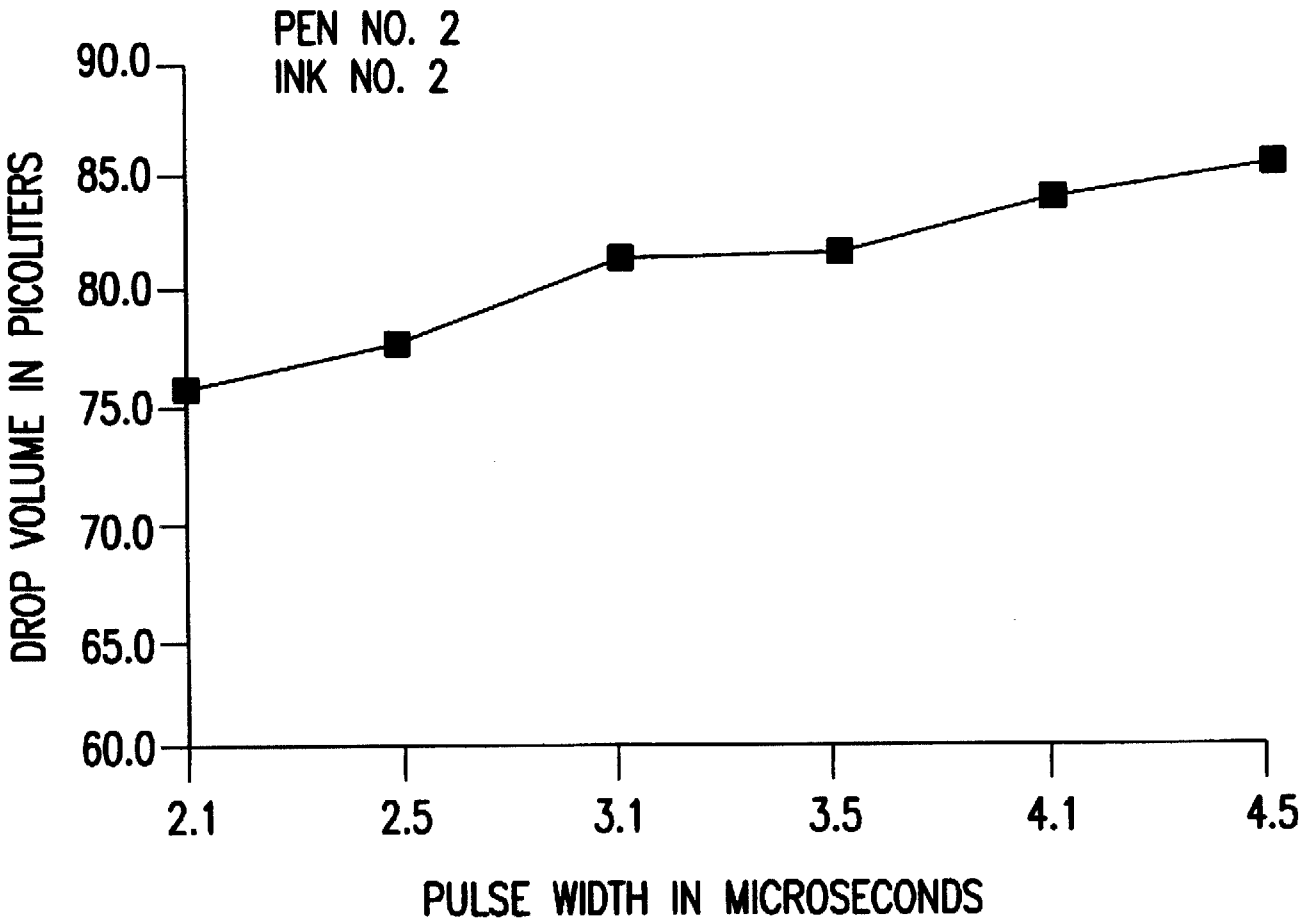
FIG. 10 shows the effect of pulse width on drop volume for a pen identified as Pen No. 2 and the ink identified as Ink No. 2.

FIGS. 8, 9 and 10 show the drop volume versus pulse width for a two different printheads and two different inks in accordance with the present invention. Both inks are black pigment inks with polymer based dispersants. Ink 1 has 3.6% pigment and 1.8% dispersant and Ink 2 has 4.0% pigment and 2.0% polymer dispersant. The relevant difference between Pen 1 and Pen 2 is the resistor size. The resistor size was 45 and 48 microns for Pens 1 and 2, respectively. FIGS. 8, 9 and 10 demonstrate the drop volume control that can be obtained by using the present invention which varies the pulse width of the firing pulses. The method also keeps the pulse width from falling below the minimum value for acceptable reliability.

The foregoing description of the preferred embodiment of the present invention has been presented for the purposes of illustration and description. It is not intended to be exhaustive, nor to limit the invention to the precise form disclosed. Obviously many modifications and variations are possible in light of the above teachings. The embodiments where chosen in order to best explain the best mode of the invention. Thus, it is intended that the scope of the invention be defined by the claims appended hereto.

What is claimed is:

1. A method of operating a thermal inkjet printer having a thermal inkjet printhead, comprising the steps of:

selecting a first ink drop volume;

selecting a first pulse width that will cause the thermal inkjet printhead to deposit an ink drop having the first drop volume;

operating the thermal inkjet printhead with the first pulse width and at an operating energy that is substantially equal to a sum of a turn-on energy of the printhead for the first pulse width and a constant over-energy;

selecting a second ink drop volume that is different from the first ink drop volume;

selecting a second pulse width that is different from the first pulse width and will cause the thermal inkjet printhead to deposit an ink drop having the second drop volume; and operating the thermal inkjet printhead with the second pulse width and at an operating energy that is substantially equal to a sum of a turn-on energy of the printhead for the second pulse width and the constant over-energy.

2. A method of operating a thermal inkjet printer having a thermal inkjet printhead, comprising the steps of:

determining for the printhead respective turn-on energies for a plurality of different pulse widths that produce ink drops of respectively different ink drop volumes, whereby each of the plurality of different pulse widths has a corresponding turn-on energy and a corresponding ink drop volume;

determining for the plurality of pulse widths operating energies respectively associated with said different pulse widths, each operating energy being substantially equal to a sum of a corresponding turn-on energy and a constant over energy; and operating the thermal inkjet printhead at a selected pulse width and an associated operating energy.

3. A method of operating a thermal inkjet printer having a thermal inkjet printhead, comprising the steps of:

determining a first pulse width that will cause the thermal inkjet printhead to deposit an ink drop having a first selected drop volume;

determining a first thermal turn-on energy of the printhead for the first pulse width;

determining for the first pulse width a corresponding first operating energy is substantially equal to a sum of the first thermal turn-on energy and a constant over-energy;

determining a second pulse width that is different from the second pulse width and will cause the thermal inkjet printhead to deposit an ink drop having a second selected drop volume that is different from the first selected drop volume;

determining a second thermal turn-on energy of the printhead for the second pulse width;

determining for the second pulse width a second operating energy that is substantially equal to the sum of the second turn-on energy and the constant over-energy; and operating the thermal inkjet printhead with one of the first and second pulse width at a corresponding one of said first and second operating energy.

* * * * *